US009835298B2

(12) United States Patent
Doyle

(10) Patent No.: US 9,835,298 B2
(45) Date of Patent: Dec. 5, 2017

(54) ACCENT LIGHT WITH TUBE IN TUBE NICHE FIXTURE AND WATER CHANNEL COOLING LIGHT HOUSING

(71) Applicant: Pentair Water Pool and Spa, Inc., Sanford, NC (US)

(72) Inventor: Kevin Doyle, Deerfield Beach, FL (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 209 days.

(21) Appl. No.: 13/707,591

(22) Filed: Dec. 6, 2012

(65) Prior Publication Data

US 2013/0100651 A1 Apr. 25, 2013

Related U.S. Application Data

(63) Continuation-in-part of application No. 13/206,499, filed on Aug. 9, 2011.

(51) Int. Cl.

| | |
|---|---|
| ***F21L 4/00*** | (2006.01) |
| ***F21V 25/00*** | (2006.01) |
| ***F21V 31/00*** | (2006.01) |
| ***F21S 8/02*** | (2006.01) |
| ***F21V 29/58*** | (2015.01) |
| *E04H 4/14* | (2006.01) |
| *F21W 131/401* | (2006.01) |

(52) U.S. Cl.

CPC ..... *F21L 4/00* (2013.01); *F21S 8/024* (2013.01); *F21V 29/58* (2015.01); *E04H 4/148* (2013.01); *F21W 2131/401* (2013.01); *Y10T 29/49002* (2015.01)

(58) Field of Classification Search

CPC .. F21S 8/00; F21S 8/024; F21V 29/02; F21V 29/58; F21W 2131/401; E04H 4/148; F21L 4/00; Y10T 29/49002

USPC ..... 362/101, 373, 158; 29/592.1

See application file for complete search history.

(56) References Cited

U.S. PATENT DOCUMENTS

| | | | | |
|---|---|---|---|---|
| 1,968,072 A * | 7/1934 | Creighton | ..... | 362/101 |
| 3,192,379 A * | 6/1965 | De Garmo | ..... | F21S 8/00 362/267 |
| 3,339,066 A * | 8/1967 | Hart | ..... | F21S 8/00 362/267 |
| 5,207,499 A * | 5/1993 | Vajda et al. | ..... | 362/96 |
| 5,349,505 A * | 9/1994 | Poppenheimer | ..... | F21S 8/00 362/101 |
| 5,432,688 A * | 7/1995 | Tobias et al. | ..... | 362/101 |

(Continued)

*Primary Examiner* — Tsion Tumebo

(74) *Attorney, Agent, or Firm* — Quarles & Brady LLP

(57) ABSTRACT

An underwater pendant light installation within a wall of a water feature has an installation tube in a niche tube having a facia section at the terminus of the niche tube. One terminus of the niche tube in communication with the water feature and having a water inlet coupled to a water gap section. An at least one underwater pendant or accent light having a housing, a lens body, an electronics section, an at least one heat sink, and one or more LEDs is mounted within the niche tube. The underwater pendant or accent light being coupled in a watertight fashion to a power source through the watertight coupling and being contained within the niche tube such that the water gap section surrounds at least in part the housing and permits water from the water feature to circulate in contact the housing but not penetrate into the watertight electrical connection.

19 Claims, 6 Drawing Sheets

(56) References Cited

U.S. PATENT DOCUMENTS

| | | | | |
|---|---|---|---|---|
| 5,727,873 | A * | 3/1998 | Tyson | 362/294 |
| 5,842,771 | A * | 12/1998 | Thrasher et al. | 362/101 |
| 6,629,320 | B1 * | 10/2003 | Gardenier et al. | 4/541.5 |
| 8,042,748 | B2 * | 10/2011 | Hagaman | B05B 1/3013 239/17 |
| 2005/0036305 | A1 * | 2/2005 | Kersey | A61H 33/6063 362/149 |
| 2005/0111222 | A1 * | 5/2005 | Olsson et al. | 362/267 |
| 2008/0165547 | A1 * | 7/2008 | Amor | B63B 45/02 362/373 |
| 2010/0246178 | A1 * | 9/2010 | Giardina et al. | 362/249.02 |

* cited by examiner

ACCENT LIGHT WITH TUBE IN TUBE NICHE FIXTURE AND WATER CHANNEL COOLING LIGHT HOUSING

CROSS-REFERENCE TO RELATED APPLICATIONS

This application is a continuation in part of and claims priority to U.S. patent application Ser. No. 13/206,499, filed Aug. 9, 2011, which is incorporated herein by reference.

BACKGROUND OF THE INVENTION

Field of the Invention

The invention relates to a LED underwater pool light, more specifically an exemplary embodiment of an underwater LED light known as a pendant or accent light in the industry and a niche fixture for same.

Background of the Invention

Existing LED underwater pendant or accent lights have known reliability issues in remaining water tight. One example of an existing pendant light is the light produced by Nexxus Lighting and sold as the SAVI-MELODY LED light. There have been a number of issues in these popular existing designs with leaks and warranty claims based on broken seals. In existing LED lights, expansion from heat generated by the LEDs and the electronics often causes unacceptable expansion pressures on the seals and the housing of the accent or pendant light. This results in eventual fatigue and failure in the soundness of the housing. Besides rendering the LED non-functional and causing warranty claims issues, water infiltration also poses potential safety issues in submerged lighting. There are several ways to address the issue, including redesign of the thermal load carrying components, reducing heat output, or increasing thermal load diffusion into the surroundings. Thus, redesign of this type of light fixture to resolve the expansion pressure issue can also be accompanied by provision of solutions for additional cooling and/or reduction of thermal loading.

A need exists for an improved LED pendant or accent light that does not exhibit the debilitating issues with transmitted thermal expansion pressures and failure of the watertight housing which also incorporates active cooling within a fixture that provides a safe and watertight connection as well as improves ease of installation. The instant invention provides for an improved light that is more reliable and has better thermal energy transport away from the thermal sources and a fixture to aid in same as well as improve installation efficiency and safety. In addition, installation of these types of lights is generally completed through fishing an electrical line through to the fixture. Often the smallest obstruction in the line can cause installation issues. A need exists for improved designs in the fixtures to assist in installation of the fixture and guidance of the electrical line to the fixture.

SUMMARY OF THE INVENTION

An aspect of the invention is to provide a more efficient heat sink that accommodates thermal expansion and reduces pressure on water tight seals in an underwater LED pendant or accent light.

A further aspect of the invention is to provide a further thermally conductive cooling path in an underwater LED pendant or accent light that allows heat to radiate from the heat sink into the body of water through a thermal pathway provided in the underwater LED pendant or accent light.

Yet another aspect of the invention is provision of a water gap within the installation to provide direct contact of the housing with the water in the installation and allow increased cooling across a greater surface area.

Still a further aspect of the invention is provision of a niche sleeve which is placed within an installation tube and provides a wire guide portion to facilitate more efficient installation of the wiring for the accent light, the wire then being coupled through the housing of the light and the housing of the light being installed within the niche sleeve with a watertight seal to prevent contact with the power source wire and a water gap between the niche sleeve and the housing.

Another aspect of the invention is an improved method of installing a light within an installation tube in a water feature allowing the installation tube to be left at a convenient length protruding from the water feature wall, the tube being cut to length, a niche sleeve being installed with a facia to provide a finished look to the outlet and providing an installation point for the accent light.

The invention includes an article of manufacture, an apparatus, a method for installing the article, and a method for using the article in an installation.

The method of the invention includes a method of using a heat sink in a submerged accent light to provide reduced pressure on the water tight light housing, having the steps of assembling a water tight accent or pendant light having a lens, a coupling to a power source, an electrical section, an at least one LED, and the heat sink assembled and contained in the housing; providing an at least one thermal expansion slot in the heat sink and a thermal conductive path from the heat sink to the housing and lens such that the thermal expansion slot permits thermal expansion of the heat sink as it absorbs heat from the at least one LED and the electronics section; and installing and cooling the submerged accent light in an installation in a body of water through the thermal conductive path.

The apparatus of the invention includes an underwater pendant or accent light in contact with a body of water. The apparatus having a housing with an at least one water tight end fitting at a first end of the housing and an at least one lens at a second end of the housing. An electronics section including an at least one controller contained within the housing and coupled to a power source. An at least one LED is coupled to the electronics section. An at least one heat sink is coupled to the at least one LED and the electronics section, the heat sink thermally coupled to and mounting the at least one LED and thermally coupled to the electronics section such that heat is communicated through the at least one heat sink, the heat sink having an at least one thermal expansion slot to accommodate thermal expansion of the heat sink as it absorbs heat, wherein the heat sink is in thermal communication through a thermal path with the housing and transmits the absorbed heat through the housing and lens to the body of water.

The underwater pendant or accent light can also provide an at least one water tight gasket or fitting, fit between the second end of the housing and the lens to render the housing water tight. The housing, the at least one water tight end fitting, the lens, and the heat sink can be generally cylindrical. The heat sink can be constructed from a thermally conductive plastic as can the housing. The heat sink can be constructed from a thermally conductive metal or composite as can the housing.

The at least one LED can be mounted on a LED printed circuit board that can be in communication with the controller in the electronics section. The at least one thermal expansion slot can be a single thermal expansion slot that is uniform along a side of the heat sink. The at least one thermal expansion slot can be non-uniform along a side of the heat sink. The thermal expansion slot can also be a single thermal expansion slot and can further comprise an at least one semi-circular portion of the thermal expansion slot permitting a further electrical coupling to pass between the electronics section and the at least one LED. The thermal expansion slot can be more than one thermal expansion slot passing through a part or the entirety of the heat sink, the heat sink sidewall, and/or the heat sink top.

The light can include additional thermal pathway structures coupling the heat sink to at least one of the at least one LED, the electronics section, and the housing. It can also include an at least one mounting device external to the housing and providing mounting of the light in the body of water.

The apparatus of the invention also includes an accent or pendant LED light submerged in a pool or spa or water feature within a return line or niche in the pool or spa or water feature, having a generally cylindrical water tight housing constructed of a thermally conductive material having a first water tight coupling at one end of the cylindrical housing, the first water tight coupling having a connection to a power source and a second water tight coupling having a lens and at least one water tight gasket at the other end of the cylindrical housing. It also has an electronics section, including a controller, a thermocouple and a first printed circuit board in electrical communication with a second printed circuit board mounting an at least one LED and controlling the at least one LED; a generally cylindrical heat sink having an at least one thermal expansion slot thereon, the heat sink having a cylindrical sidewall and a top covering one end of the sidewall and a hollow interior within the cylindrical sidewall and below the top, the at least one thermal expansion slot extending along the length of the cylindrical sidewall and through a portion of the top. Where the at least one thermal expansion slot accommodates thermal expansion of the heat sink as it absorbs heat from the electronics section and the at least one LED with the heat sink in thermal communication through a thermal path with the housing and transmitting the absorbed heat through the housing and lens to the pool or spa or water feature.

The article of manufacture of the invention includes an accent or pendant LED light submergible in a pool or spa or water feature within a return line or niche in the pool or spa or water feature, the light having a generally cylindrical water tight housing constructed of a thermally conductive material having a first water tight coupling at one end of the cylindrical housing, the first water tight coupling having a connection to a power source and a second water tight coupling having a lens and at least one water tight gasket at the other end of the cylindrical housing with an electronics section including a first printed circuit board in electrical communication with a second printed circuit board mounting an at least one LED and controlling the at least one LED; a generally cylindrical heat sink having an at least one thermal expansion slot thereon the heat sink having a cylindrical sidewall and a top covering one end of the sidewall and a hollow interior within the cylindrical sidewall and below the top, the at least one thermal expansion slot extending along the length of the cylindrical sidewall and through a portion of the top, the method comprising the steps of assembling the at least one LED to the second printed circuit board with the heat sink and the electronics section, assembling the housing with the first water tight coupling to the end of the housing and coupling the electrical source to the electronics section, assembling the housing with the second water tight coupling having a lens and an a least one water tight gasket; and operating the light.

The apparatus of the invention includes an underwater pendant or accent light installation within a wall of a water feature having an installation tube and a niche tube having a facia section at the terminus of the niche tube in communication with the water feature and having a water inlet coupled to a water gap section. An at least one underwater pendant or accent light having a housing, a lens body, an electronics section, an at least one heat sink, and an at least one LED, the underwater pendant or accent light being coupled in a watertight fashion to a power source through the watertight coupling is contained within the niche tube such that the water gap section surrounds at least in part the housing and permits water from the water feature to circulate in contact the housing but not penetrate into the watertight electrical connection.

The niche tube can be coupled to the niche facia which is coupled to the lens body with the water inlet therein such that water from water feature cools the lens body as well as the housing and thereby the underwater pendant or accent light. An at least one wire guide section in communication with the watertight electrical coupling can be included.

An at least one flange section at the terminus of the water gap formed between the niche tube and the housing closest to the watertight coupling can also be provided. An at least one sealing member can be spaced between the housing and the flange section.

The at least one heat sink can further contain an expansion slot therein. An at least one set of threads coupling the electrical source with the pendant or accent light can be provided. An at least one threaded coupling coupling the lens body to the housing and at least one threaded coupling coupling the facia and lens body can be provided. The niche tube can also be affixed within the installation tube with at least one of an at least one friction coupling, mechanical fastener, and an adhesive. The wire guide section can provides a further watertight area between the water tight section and the electrical connector.

The method of the instant invention includes a method of assembling an accent light or pendant light within the wall of a water feature, including slidingly engaging an installation tube with a niche sleeve in said wall of said water feature, forming a water tight electrical connection with the niche sleeve, coupling an at least one accent light with a housing and an at least one lens body to the housing such that it forms a watertight electrical connection and can power said accent light therewith and engaging the lens body with a niche collar and niche sleeve where a water gap is provided between the niche sleeve and the housing to allow water to penetrate into the niche sleeve through openings in the lens body being held by the niche collar and the water gap cools the housing of the at least one accent light.

The method of the invention further includes a method of installing accent light or pendant light within the wall of a water feature, including installing an installation tube in said wall of said water feature, cutting said tube flush with said wall, installing a niche sleeve with an at least one wire guide therein into the installation tube, threading an electrical source coupling wire through the installation tube and the nice sleeve, coupling an at least one watertight electrical coupling to the electrical source coupling wire, inserting the coupling into the sleeve to create a watertight coupling with an electrical source, coupling a housing of an accent light, having a lens assembly attached thereto, in a watertight fashion to the watertight coupling with the electrical source, and installing a niche collar around the housing and to the niche sleeve such that a water gap is provided to allow water to flow from the water feature in and around the housing and cool the housing and the lens assembly. The method can further include affixing the niche tube within the installation tube. The affixing of the niche tube can include affixing the niche tube with at least one of an at least one friction coupling, mechanical fastener, and adhesives.

Moreover, the above objects and advantages of the invention are illustrative, and not exhaustive, of those which can be achieved by the invention. Thus, these and other objects and advantages of the invention will be apparent from the description herein, both as embodied herein and as modified in view of any variations which will be apparent to those skilled in the art.

BRIEF DESCRIPTION OF THE DRAWINGS

Embodiments of the invention are explained in greater detail by way of the drawings, where the same reference numerals refer to the same features.

DETAILED DESCRIPTION OF THE INVENTION

Figure 1:
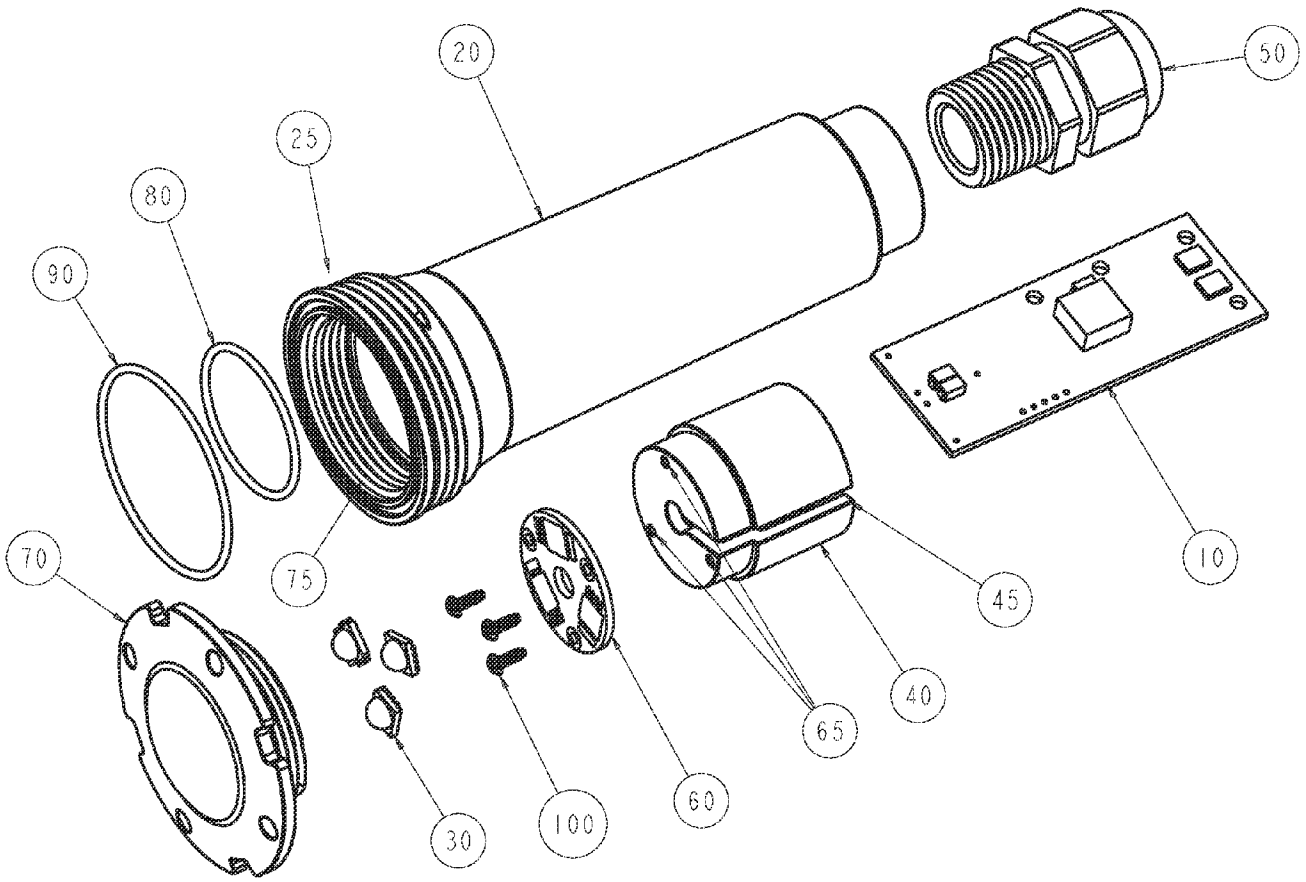
FIG. 1 is an exploded view of an exemplary embodiment of the instant invention.

FIG. 1 shows an exploded view of an exemplary embodiment of the instant invention. The instant invention is driven by an electronics section 10, the electronics section 10 having for instance a controller on a printed circuit board located within a housing 20. The housing in this exemplary embodiment can be constructed of a thermally conductive material, such as a thermally conductive plastic or similar material that has high thermal transmissivity. The housing 20, when assembled, will be fully submerged in a body of water (not shown), including for instance but certainly not limited to a water feature, lake, pond, pool, or spa and must therefore be made water tight or water proof A watertight fitting 50 coupling the light to a power source (not shown) is provided at one end of the watertight housing 20. The water tight fitting 50 may also render the light self contained with a power source, such as a battery, incorporated into the light or coupled to an alternative source of power through an appropriate coupling. On the other end of the watertight housing 20 as shown, a set of optional external threads 25 are provide for mounting the light in the body of water. The external threads 25 are used with or without a mounting device (not shown) to hold the light within the body of water within the pool or water feature. Additional methods of retaining the accent light may be utilized for example, but not limited to, adhesives, wedges, or similar mechanisms or materials. A set of internal threads 75 are provided inside the housing to retain the lens 70. An at least one water tight gasket or fitting 80, 90 is placed between the screw on lens or lens body 70 and the inside threads 75. In the exemplary embodiment shown, a set of o-ring gaskets 80, 90 are provided and fit between the lens 70 and the watertight housing 20. Various types and numbers of gaskets or fittings can be utilized or the end may be a unitary construction incorporating the lens or optic without departing from the spirit of the invention to attach the lens or lens body 70 to the housing 20 and provide a water tight seal. The housing 20, is positioned in the body of water so that the lens 70 points into the body of water to provide a pleasing lighting affect. This can occur, for instance, in recesses provided in the body of water or within piping for the body of water (not shown), for instance a water return on a pool or spa or water feature.

Within the water tight housing 20 an at least one LED 30 is provided. The at least one LED 30 is potted with a thermally conductive potting material on an LED printed circuit board 60. The at least one LED 30 potted on the LED printed circuit board 60 is further potted and/or coupled, both mechanically and thermally, to a heat sink 40. The LED printed circuit board 60 can be further secured to the heat sink 40 by an at least one affixing device 100, shown in the exemplary embodiment as mounting screws 100. The mounting screws 100 fit into pre-drilled mounting points 65 in the heat sink 40. The coupling of the LED printed circuit board 60 is provided such that it can expand with the heat sink 40 as the heat sink 40 absorbs heat. A non limiting example to accommodate the expansion is to provide a further slot in the LED printed circuit board 60. Another non-limiting example is to select a printed circuit board or mounting screws that can accommodate loading and/or flexing from the expansion. Various other mechanical and non-mechanical changes can be made to accommodate the expansion and are well within the spirit of the invention.

The heat sink 40 is composed of thermally conductive material. In the exemplary embodiment of the invention shown, the heat sink 40 is constructed of, for instance but certainly not limited to, a thermally conductive metal, such as copper, brass, or aluminum, or a thermally conductive plastic in the exemplary embodiment shown. The heat sink 40 may also be comprised of a composite, a metal alloy or any suitable material with the desired thermal properties to allow for thermal loading and transmission.

Figure 2:
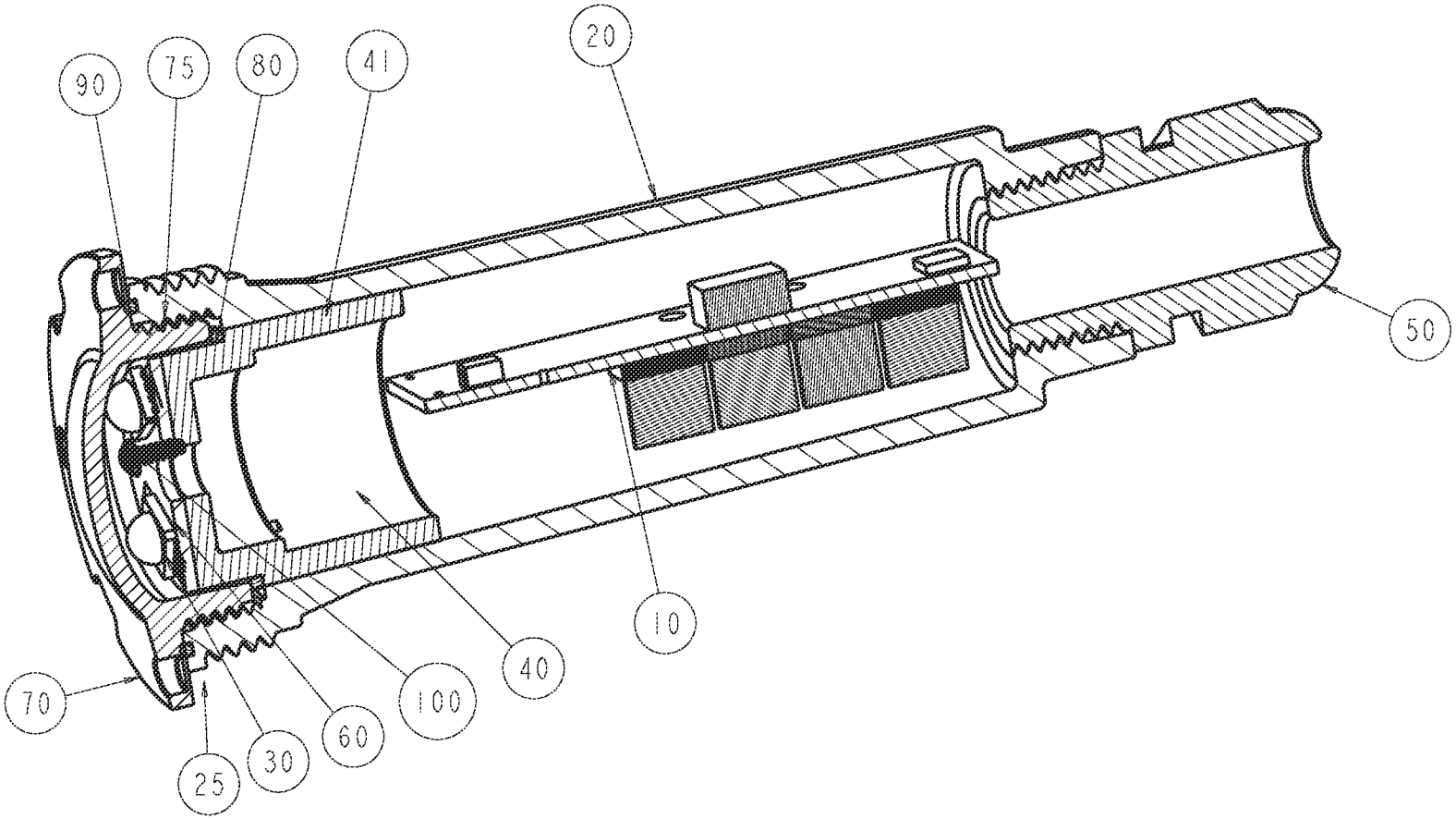
FIG. 2 is a cross sectional view along mid line of embodiment of FIG. 1.

In the exemplary embodiment shown, as better seen in FIG. 2, the heat sink 40 is placed in contact and thereby thermal communication with the housing 20. In the exemplary embodiment the heat sink 40 is potted in place with a thermal paste. This contact can be around the entirety of the heat sink 40 or around a portion of the heat sink 40. The thermally conductive material of the heat sink 40 conducts heat away from the at least one LED 30 and the electronics section 10. As the heat sink 40 is thermally coupled with the water tight housing 20 and through the water tight housing 20 to the lens 70, the heat sink 40 conducts heat into the water tight housing 20 and lens 70 and, thereby, into the water of the body of water immediately surrounding the water tight housing 20 and lens 70. This permits a greater efficiency in the cooling of the at least one LED and the electronics section 10 having the controller and electronics, especially when placed within piping or an active flow of water within the body of water. The heat sink 40 also has an at least one thermal expansion slot 45 theron.

In the exemplary embodiment shown, the at least one thermal expansion slot is a single thermal expansion slot 45 with a uniform width throughout. In further embodiments, more than one thermal expansion slot can be provided. Similarly, in still further embodiments modifications to the width of the at least one thermal expansion slot 45 and variations in the uniformity of the at least one thermal expansion slot 45 are contemplated and well within the spirit of the invention. For instance, the at least one thermal expansion slot 45 can include semi-circular cutouts to provide for clearance of connecting wires and the like, see for instance FIG. 3A. This clearance for electrical couplings being a further benefit of the heat sink 40 having the thermal expansion slot making manufacture and assembly of the light easier and more cost efficient.

The thermal expansion slot 45 in the light provides a path for expansion as the heat sink 40 absorbs heat from the components of the light. The expansion slot 45 reduces pressure from the expansion of the heat sink 40 on the water tight housing 20. The space in the expansion slot 45 allows for the ends of the heat sink 40 to move through the thermal expansion and through the movement reduce the width of the expansion slot 45, thus reducing outward pressure on the water tight housing 20. This, in turn, results in less potential for rupture or cracking occurring in the water tight housing 20.

The heat sink 40 is thermally coupled to the LED printed circuit board 60 which is thermally coupled to the at least one LED 30. The whole arrangement is thermally coupled to the housing 20 and the lens body 70, such that a thermal pathway is expediently provided for direct conductive transmission of heat from the pendant or accent light into the body of water as a heat dump. In an exemplary embodiment, a thermally transmissive compound is used to provide a thermal path for the heat through out the coupled components, for instance a thermal past or potting compound. Special thermal pathway structures, such as micro heat pipes, can also be added to provide additional thermal transmission throughout the light. The thermal path to the water surrounding the housing 20 allows for the use of higher power LEDs. Additionally, although the instant invention provides improved thermal transmission, a thermocouple limiter is provided in the electronics section 10, for instance on the printed circuit board with the controller, to prevent thermal damage if, for some reason, temperatures exceed the maximum limits of the electrical components.

The light is assembled with the water tight fitting 50 coupled to a power source (not shown) and secured to one end of the watertight housing 20 and the lens or lens body 70 is screwed into the internal threads 75 with the at least one gasket member 80, 90 with the heat sink 40, the at least one LED 30, and the LED printed circuit board 60 mounting the at least one LED. These are coupled together or held in place with a thermal compound, such as a thermally transmissive paste. The LED printed circuit board 60 is coupled to the electrical section 10 and the controller contained therein on a printed circuit board, in this instance the same board as LED printed circuit board 60. Thus in the exemplary embodiment shown, the at least one LED printed circuit board 60 has the controller controlling the at least one LED 30. In further embodiments, the controller may be incorporated on its own printed circuit board or on a circuit board that is in communication with the accent light and controlled as a slaved light to a master controller in a pool light control system.

FIG. 2 is a cross sectional view along mid line of embodiment of FIG. 1. As seen in FIG. 2, the watertight housing 20 is engaged with the water tight fitting 50, here the fitting is screwed into the housing however it may be engaged in any fashion to provide a water tight connection, and the lens body 70 which is threaded onto the internal threads 75 and the at least one gasket 80, 90 being engaged to provide a sound, water tight housing 20. The housing 20, the water tight fitting 50, and lens 70 with the at least one gasket 80, 90 of the exemplary embodiment shown are generally cylindrical as is the heat sink 40. The heat sink is further hollowed as shown, allowing it to expand effectively and efficiently along the thermal expansion slot 45 and permitting easier pathing of electrical connectors and more efficient assembly of the light. The specific shape can, however, be varied without departing from the spirit of the invention, provided that the at least one expansion slot 45 within the heat sink 40 can provide for reduced pressures being exerted on the housing 20 due to thermal expansion and the effective transmission of the thermal load to the water surrounding the light.

Within the housing, the at least one LED 30 is provided mounted on the at least one LED printed circuit board 60 and these are coupled to the heat sink 40. The heat sink 40 is in or nearly in communication with the housing 20. The controller and the printed circuit board in the electronics section 10 are located, in this embodiment, on the opposite side of the heat sink 40 from the at least one LED, within a hollow within the heat sink 40. The thermal expansion slot 45 is not shown clearly in this cross sectional view.

The mounting of the at least one LED 30 and the LED printed circuit board 60 in thermal communication with the heat sink 40 and the coupling of the controller and printed circuit board in the electronics section 10 in thermal communication with the heat sink 40 results in transmission of heat into the heat sink 40. The heat expands the heat sink 40, the thermal expansion slot 45 allowing for the transmission of the majority of the movement and therefore the pressure from expansion to go back into the heat sink 40, but the heat sink 40 is in or comes into communication with the housing 20 and a thermal bridge is formed with the housing 20 and the lens 70. This permits heat to transfer through the heat sink into the housing 20 and thereby into the water surrounding the light in the body of water. This results in effective cooling of the light and, with the thermal expansion slot 45 this cooling is accomplished without transmission of the majority of the pressures from thermal expansion of the heat sink 40 into the housing 20. This results in a more robust light with a longer operating life and improved soundness and less warranty claims as the expansion pressures from the thermal loading are significantly reduced, in fact almost removed.

Figure 3A:
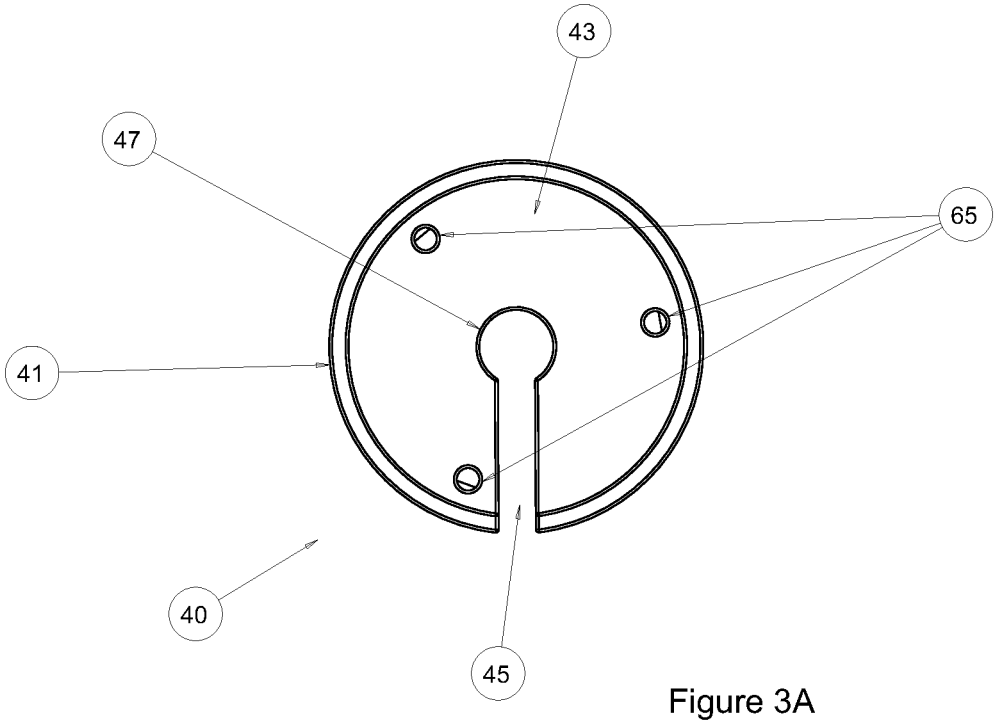
FIG. 3A and 3B show a front view and a side view, respectively, of an exemplary embodiment of a heat sink utilized in the instant invention.
Figure 3B:
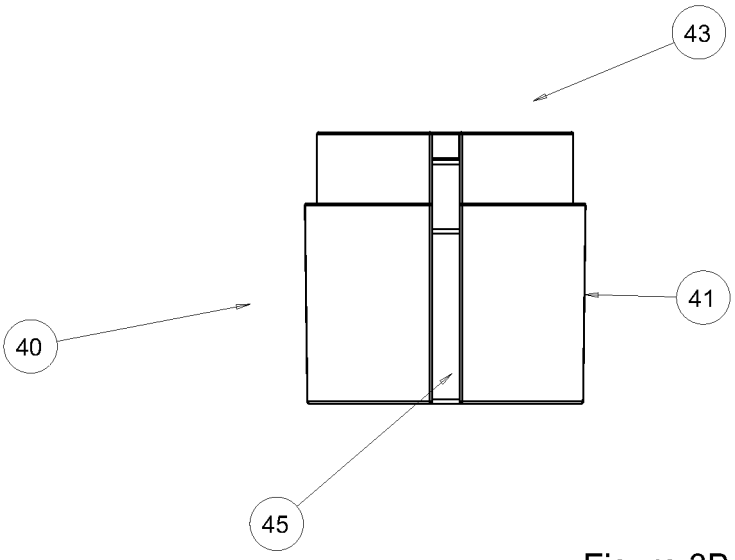

FIGS. 3A and 3B show a front view and a side view, respectively, of an exemplary embodiment of a heat sink utilized in the instant invention. FIG. 3A shows the front view of the heat sink 40 of an exemplary embodiment of the invention. The exemplary embodiment shown is a generally cylindrical heat sink 40 having an at least one thermal expansion slot 45 thereon. The heat sink 40 having a cylindrical sidewall 41 and a top 43 with a hollow interior within the cylindrical sidewall 41 and below the top 43. The at least one thermal expansion slot 45 extending along the length of the cylindrical sidewall 41, as best seen in FIG. 3B, and through a portion of the top 43 as shown in FIG. 3A. The exemplary embodiment provides for mounting points 65 for the LED printed circuit board 60, the at least one thermal expansion slot 45 and, in the embodiment shown, a circular portion of the thermal expansion slot 47. The circular portion 47 on the front or top 43 of the heat sink 40 provides a path for wiring from the controller in the electronics section 10 to the LED printed circuit board 60 when the light is assembled. The remainder of the thermal expansion slot 45 is uniform through the front or top 43 of the heat sink 40.

FIG. 3B shows the side view of the heat sink 40 of an exemplary embodiment. The thermal expansion slot 45 is clearly shown, being uniform along the length of the side of the heat sink 40 in the exemplary embodiment shown. As noted with respect to FIG. 3A, additional portions of the thermal expansion slot may have variations in the shape and structure of the thermal expansion slot 45 without departing form the spirit of the invention. Additionally, the heat sink 40 can be uniform or non-uniform in shape, for instance in the exemplary embodiment shown the generally cylindrical heat sink 40 is varied in diameter.

Figure 4:
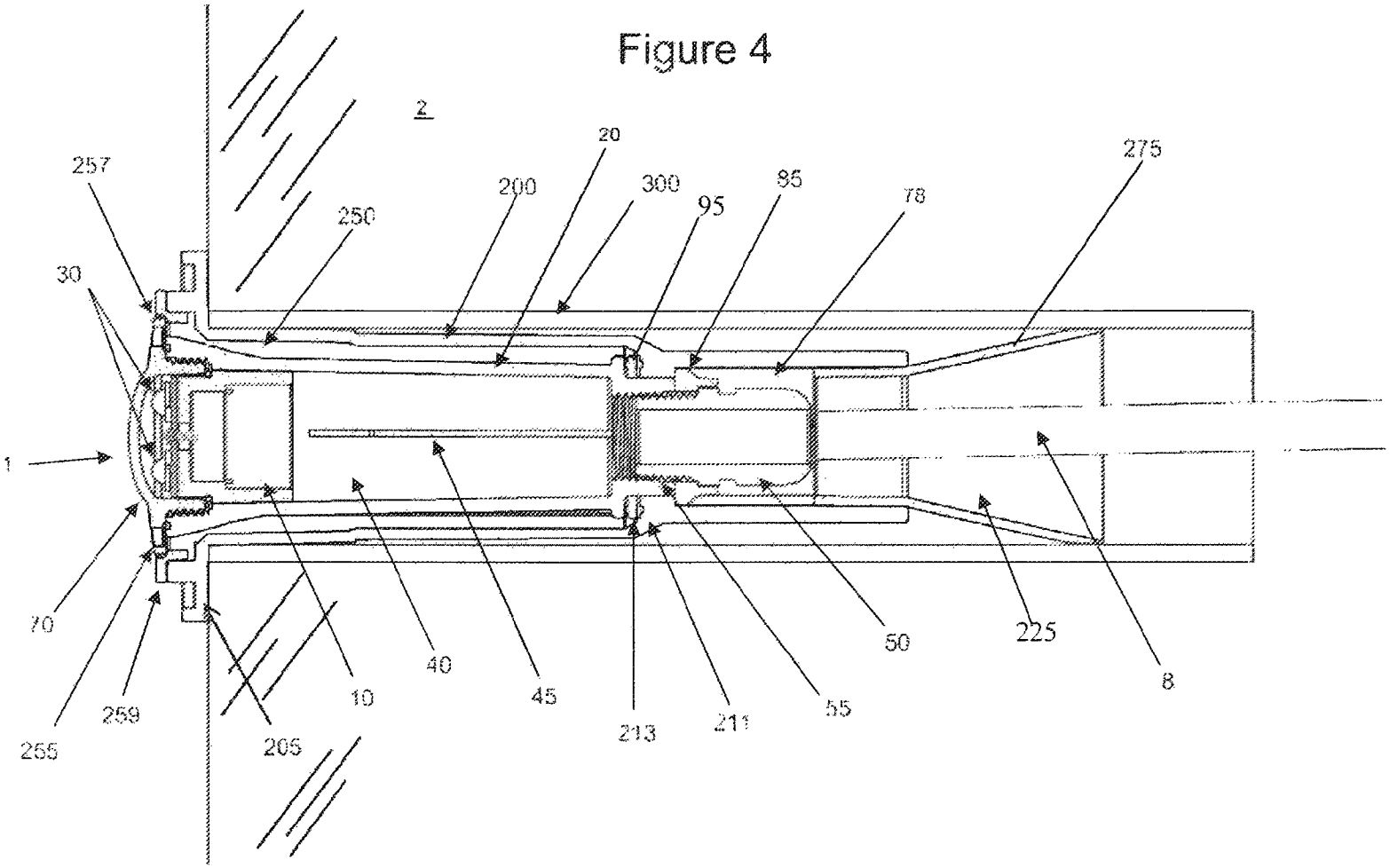
FIG. 4 shows a cross-sectional view of an exemplary embodiment of an accent light within a niche sleeve in a niche fixture installed in a water feature.

FIG. 4 shows a cross-sectional view of an exemplary embodiment of an accent light within a niche sleeve in a niche fixture installed in a water feature. In the figure, the exemplary embodiment of the accent light is shown in the niche sleeve or tube 200 within the installation tube 300. The installation tube may be a rough tube or pipe in the wall construction or simply be a tube created within the material making the wall, for example it may be formed by the concrete or other material used to construct the water feature. Within the niche sleeve 200 is an accent light housing or housing 20 similar to that shown in the exemplary embodiment of such a light shown in FIGS. 1-3 above. A water inlet gap 250 is provided between the housing 20 and the niche sleeve 200 and allows water from the pool penetrate into the space or water gap 250 between the niche sleeve 200 around the housing 20 for cooling without affecting the watertight electrical connection. As noted previously, housing 20 and lens body 70 are submerged within the water feature and cooled by contact with the water therein without compromising the watertight integrity of the housing 20.

A set of external threads 25 is provided and engaged by lens body 70. Lens body 70 is coupled to the niche sleeve 200 having a niche collar or facia 205 with an exposure slot or inlet 255 which opens to the water gap 250 allowing water through the inlets 255 in the niche collar 205. The niche sleeve 200 terminates at the niche collar 205 at the end of the fixture which mounts flush to the installation tube 300. In addition to the niche collar 205, a retaining member 257 with retaining slot 259 is shown in the exemplary embodiment of FIGS. 4 and 5. This is one system for securing the lens body 70 within the niche collar. Additional methods include but are certainly not limited to adhesives, thermowelding, fasteners, threads with matching grooves, or similar means, either permanent or nonpermanent. Additionally, the niche collar 205 can contain the system by which the lens body 70 is coupled thereto. Similarly, there can be an affixing member for affixing the niche collar 205 and thereby the niche sleeve in the installation tube or, as shown in the exemplary embodiment, these can be affixed via a friction coupling. Other affixing mechanisms may be used, for example including but not limited to, mechanical fasteners, adhesives, and the like.

Within the housing 20 an at least one LED 30 is provided. Again, as shown in previous FIGS. 1-3, the at least one LED 30 is potted with thermally conductive potting material on an LED printed circuit board 60 which is coupled to a heat sink 40. Although the heat sink shown in FIG. 4 has a thermal expansion slot 45 and is similar to the heat sink described in the previous FIGS. 1-3 above, the niche sleeve 200 may be utilized with any housing and heat sink which may be applicable for use in an accent light. In addition, different types of lights that require placement within an installation tube 300 in a water feature are fully contemplated. Reference is made herein to an accent light as a non-limiting example. This reference is also made as this is the general term of art for such lights in the application in water features and, in particular, pools and spas. Further as noted above, as the niche sleeve provides additional thermal load dissipation it can on its own relieve the issue with pressure from thermal expansion and can therefore be combined with existing designs. However, this thermal dissipation in conjunction with the modifications of FIGS. 1-3 provide an excellent system for removing thermal load and accommodating thermal expansion pressures in an accent light in a water feature.

Within the housing 20, an electronics section 10 is also provided having a controller, again mounted on an at least one LED printed circuit board 60, and electronics for the at least one LED accent light 1. The electronics section 10 is coupled electrically through the threaded watertight electrical fitting 50 to an electrical power source (not shown) through wire 8. As seen in FIG. 4, the watertight electrical fitting 50 is coupled to a threaded connector section 55 which couples the electrical fitting 50 to the housing and to a wire 8 in a watertight fashion. At this end of the niche sleeve 200 in addition to the watertight electrical fitting 50 and threaded portion 55 of the housing 20, a further sealing member 85 is provided at the juncture between the watertight electrical fitting 50 and the niche sleeve 200. This ensures integrity of the water tight seal of the electrical fitting 50 at the housing 20. Additionally, at the end of the water gap 250 a seat 275 is provided for the housing 20. A further seat sealing member 95 is provided therewith to further ensure the water tight integrity of the coupling of the wire 8 with the housing 20. This further watertight area 78 is provided behind the coupling due in part to the wire guide section 225 as further described below.

At the terminus of the niche sleeve 200 opposite the lens body 70 is a further wire guide section 225. Wire guide section 225 is flared such that it provides an additional barrier to potential leaks beyond collar 205 and it assists in maintaining water tightness within the installation tube. In addition to maintaining water tightness the wire guide section 225 assists in the threading of wire 8 to the point of connection for light 1 during installation. The housing 20 with the water gap 250 isolates the water gap 250 providing overlapping flange 213 with a sealing member 211.

During construction of pool, and the walls of the pool or water future, installation tubes 300 are provided in and through the walls of the water feature. One advantage of the design of the instant invention is it permits these tubes to be run out to any convenient length extending beyond the wall 2 of the water feature. The resulting installation tube 300 can be cut flush with the wall 2 of the water feature or pool. The instant invention with its niche sleeve or tube 200 can then be inserted. A wire 8 can be run within the installation tube 300 and guided via wire guide section 225 into the niche tube 200. The wire can be pulled through, then it can be easily coupled to watertight fitting 50. The coupled wire 8 and watertight fitting 50 can then be joined to the housing 20. Alternatively, the water tight fitting may be placed and then tightened within the niche tube 200 and the housing 20 then coupled therein. In either case, the accent light 1 with housing 20 can then be inserted the niche tube 200 for final installation. In this way in addition to providing improved cooling, longer life, and improved reliability, instant invention also provides greater ease of connection and greater efficiency during installation and improved safety in electrical coupling.

Figure 5:
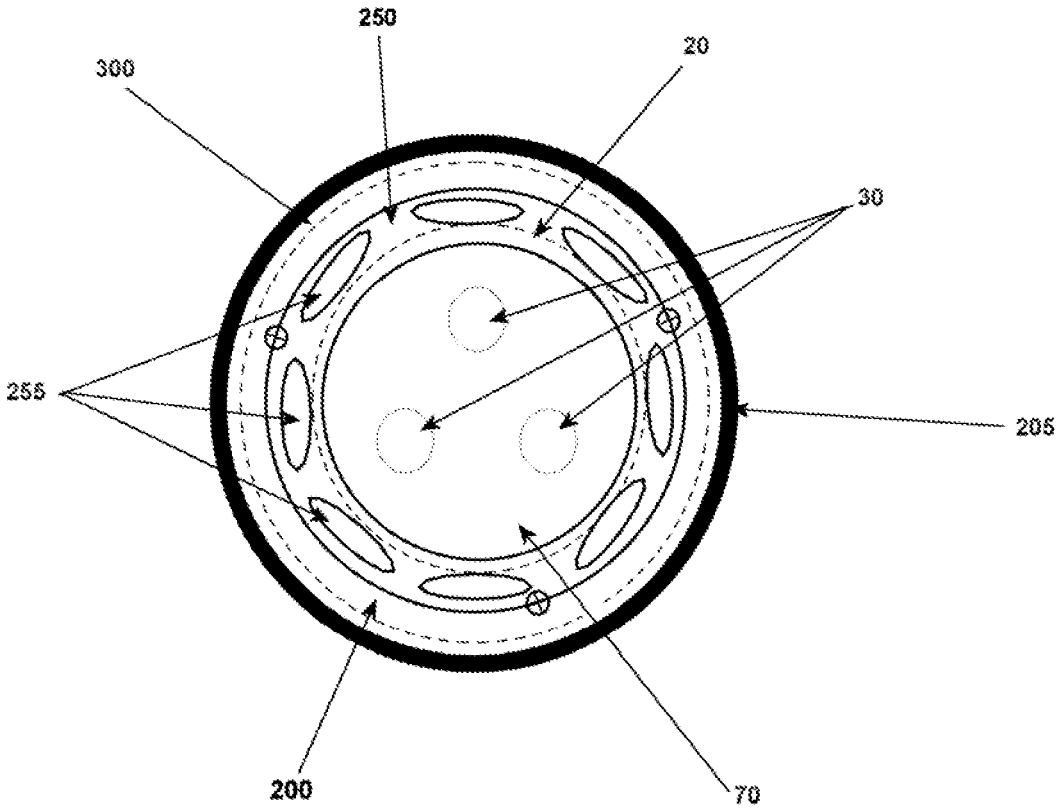
FIG. 5 shows a front view of an exemplary embodiment of the invention and fixture of FIG. 4 installed.

FIG. 5 shows a front view of an exemplary embodiment of the invention and fixture of FIG. 4 installed. The figure shows a front view of the accent light in its final installation within the niche tube inside the installation tube of the wall of the water feature. As seen in FIG. 5, the lens body 70 is figured prominently and the niche sleeve 200 (in shadow) is shown with the installation tube 300 (in shadow) allowing penetration of the water from the water feature into the niche sleeve 200 through the water inlets 255 into the water gap 250. In addition to the lens body 70 the niche collar 205 can be seen and here coupled to the niche sleeve 200 and to the lens body 70. The at least one LED 30 is shown under the lens body 70. The installation is coupled electrically to a power source (not shown) as noted previously and shines into the pool.

The embodiments and examples discussed herein are non-limiting examples. The invention is described in detail with respect to exemplary embodiments, and it will now be apparent from the foregoing to those skilled in the art that changes and modifications may be made without departing from the invention in its broader aspects, and the invention, therefore, as defined in the claims is intended to cover all such changes and modifications as fall within the true spirit of the invention.

What is claimed is:

1. An underwater pendant or accent light installation within a wall of a water feature comprising:

a niche tube disposed within an installation tube inserted into the wall of the water feature, the niche tube having an outwardly extending collar at a terminus of the niche tube in communication with the water feature and having a water inlet coupled to a water gap section; and at least one underwater pendant or accent light having: a housing positioned within the niche tube, a lens body, coupled to the housing, wherein the niche tube is coupled to the collar, which is coupled to the lens body, an electronics section positioned at least in part within the housing, an at least one cylindrical heat sink disposed within the housing, and an at least one LED disposed along a printed circuit board, the printed circuit board in direct contact with the at least one heat sink, the underwater pendant or accent light being coupled in a watertight fashion to a power source through the watertight coupling to form a watertight electrical connection and being contained within the niche tube such that the water gap section surrounds at least in part the housing and permits water from the water feature to enter through openings in the lens body and circulate in contact with the housing but not penetrate into the watertight electrical connection.

2. The pendent or accent light installation of claim 1, further comprising an at least one wire guide section in communication with the watertight electrical coupling.

3. The pendent or accent light installation of claim 1, further comprising an at least one flange section at the terminus of the water gap formed between the niche tube and the housing closest to the watertight coupling.

4. The pendent or accent light installation of claim 3, further comprising an at least one sealing member between the housing and the flange section.

5. The pendent or accent light installation of claim 1, wherein the at least one heat sink further contains an expansion slot therein.

6. The pendent or accent light installation of claim 1, further comprising an at least one set of threads coupling the electrical source with the pendant or accent light.

7. The pendent or accent light installation of claim 1, further comprising an at least one threaded coupling the lens body to the housing and at least one threaded coupling the collar and lens body.

8. The pendent or accent light installation of claim 1, wherein the niche tube is affixed within the installation tube with at least one of an at least one friction coupling, mechanical fastener, and an adhesive.

9. The pendent or accent light installation of claim 2, wherein the wire guide section provides a further watertight area between the water tight section and an electrical fitting connector.

10. A method of assembling an accent light or pendant light within the wall of a water feature, comprising:

inserting an installation tube into the wall of the water feature;

slidingly engaging a niche sleeve into the installation tube;

forming a water tight electrical connection with the niche sleeve;

coupling an at least one accent light with a housing adjacent a cylindrical heat sink that is disposed entirely within the housing, wherein the cylindrical heat sink includes a thermal expansion slot configured to allow radial expansion of the cylindrical heat sink;

coupling an at least one lens body to the housing such that it forms a watertight electrical connection and can power the accent light therewith; and engaging the lens body with a niche collar and niche sleeve, wherein a water gap is provided between the niche sleeve and the housing to allow water to penetrate into the niche sleeve through openings in the lens body being held by the niche collar and the water that enters the water gap cools the housing of the at least one accent light.

11. The method of assembling an accent light or pendant light within the wall of a water feature of claim 10 further comprising installing the installation tube in the wall of the water feature by:

forming a hole in the wall;

inserting the installation tube into the hole of the wall; and cutting the installation tube flush with the wall.

12. The method of assembling an accent light or pendant light within a wall of a water feature of claim 10, wherein the installation tube is substantially flush with the wall.

13. The method of assembling an accent light or pendant light within a wall of a water feature of claim 10 further comprising coupling a color ring to the niche collar.

14. The method of assembling an accent light or pendant light within a wall of a water feature of claim 10 further comprising coating an outer surface of the installation tube with an adhesive.

15. The method of assembling an accent light or pendant light within a wall of a water feature of claim 10, wherein the niche sleeve is secured to the installation tube with one of a friction coupling, a mechanical fastener, and an adhesive.

16. The method of assembling an accent light or pendant light within a wall of a water feature of claim 10, wherein the installation tube is a pipe.

17. A method of installing an accent light or pendant light within a wall of a water feature, comprising:

installing an installation tube in said wall of said water feature by:

forming a hole in the wall;

inserting the installation tube into the hole of the wall; and cutting the installation tube flush with the wall;

installing a niche sleeve with an at least one wire guide therein into the installation tube, the niche sleeve having an outwardly extending collar;

threading an electrical source coupling wire through the installation tube and the niche sleeve;

coupling an at least one watertight electrical coupling to the electrical source coupling wire;

inserting the coupling into the niche sleeve to create a watertight coupling with an electrical source;

coupling a housing of an accent light, having a lens assembly attached thereto and a cylindrical heat sink disposed within the housing, in a watertight fashion to the watertight coupling with the electrical source, wherein the lens assembly is coupled to the collar of the niche sleeve and wherein the cylindrical heat sink includes a thermal expansion slot configured to allow radial expansion of the cylindrical heat sink; and installing a niche sleeve collar around the housing, the housing further having a printed circuit board disposed within, and to the niche sleeve such that a water gap is provided to allow water to flow from the water feature through openings in the lens assembly and in and around the housing to cool the housing and the lens assembly.

18. The method of installing accent light or pendant light within the wall of a water feature of claim 17, further comprising affixing the niche tube within the installation tube.

19. The method of installing accent light or pendant light within the wall of a water feature of claim 18, wherein the step of affixing the niche sleeve includes affixing the niche sleeve with at least one of an at least one friction coupling, mechanical fastener, and adhesive.

* * * * *